US007819645B2

(12) United States Patent
Hosono

(10) Patent No.: US 7,819,645 B2
(45) Date of Patent: Oct. 26, 2010

(54) INTERNAL GEAR PUMP

(75) Inventor: Katsuaki Hosono, Niigata-ken (JP)

(73) Assignee: Diamet Corporation, Nigata-Ken (JP)

( * ) Notice: Subject to any disclaimer, the term of this patent is extended or adjusted under 35 U.S.C. 154(b) by 365 days.

(21) Appl. No.: 11/996,643

(22) PCT Filed: Aug. 25, 2006

(86) PCT No.: PCT/JP2006/316755

§ 371 (c)(1),
(2), (4) Date: Jan. 24, 2008

(87) PCT Pub. No.: WO2007/026618

PCT Pub. Date: Mar. 8, 2007

(65) Prior Publication Data

US 2010/0158734 A1 Jun. 24, 2010

(30) Foreign Application Priority Data

Aug. 31, 2005 (JP) ..... 2005-252374

(51) Int. Cl.
*F04C 18/00* (2006.01)
*F04C 2/00* (2006.01)

(52) U.S. Cl. ..... 418/171; 418/150

(58) Field of Classification Search ..... 418/150, 418/166, 171

See application file for complete search history.

(56) References Cited

U.S. PATENT DOCUMENTS 6,244,843 B1 * 6/2001 Kosuge ..... 418/150
6,835,054 B2 * 12/2004 Morita ..... 418/171
6,929,458 B2 * 8/2005 Hirabayashi et al. ..... 418/150
7,044,724 B2 * 5/2006 Matsumoto et al. ..... 418/201.3
7,118,359 B2 * 10/2006 Hosono ..... 418/150

FOREIGN PATENT DOCUMENTS

| | | | |
|---|---|---|---|
| GB | 233423 A | * | 5/1925 |
| GB | 2085969 A | * | 3/1982 |
| JP | 195989/1985 | | 12/1985 |
| JP | 62-151641 A | | 7/1987 |
| JP | 56589/1989 | | 4/1989 |
| JP | 4179880 | | 6/1992 |
| JP | 2003328959 | | 11/2003 |
| KR | 10-2002-0020737 A | | 3/2002 |
| KR | 10-2004-0005635 A | | 1/2004 |
| KR | 10-2004-0065970 A | | 7/2004 |

* cited by examiner

*Primary Examiner*—Theresa Trieu
(74) *Attorney, Agent, or Firm*—Leason Ellis LLP

(57) ABSTRACT

In an internal gear pump of the present invention, a first angle that is formed by a first straight line that connects a rotation axis of an inner rotor to a tooth tip portion of an external tooth in the rotational direction of the inner rotor and an outer rotor, and a second straight line that connects the rotation axis to a meshing portion of the external tooth is not less than 1.4 times the size and not more than 1.8 times the size of a second angle that is formed by a third straight line that connects the rotation axis to a tooth bottom of the external tooth, and the second straight line.

2 Claims, 4 Drawing Sheets

INTERNAL GEAR PUMP

TECHNICAL FIELD

The present invention relates to an internal gear pump that takes in or discharges a fluid using a volume change in a cell that is formed between an inner rotor and an outer rotor.

This is a U.S. National Phase Application under 35 U.S.C. §371 of International Patent Application No. PCT/JP2006/316755 filed Aug. 25, 2006, which claims the benefit of Japanese Patent Application No. 2005-252374 filed Aug. 31, 2005, both of which are incorporated by reference herein. The International Application was published on Mar. 8, 2007 as WO 2007/026618 A1 under PCT Article 21(2).

This type of internal gear pump is small in size and has a simple structure and is therefore widely used for pumps for lubricants or for oil pumps for automatic transmissions of vehicles and the like. For example, the internal gear pump illustrated in Japanese Unexamined Patent Application, First Publication No. 2003-328959 ("JP '959") is provided with an inner rotor on which "n" (n is a natural number) external teeth are formed, an outer rotor on which "n+1" internal teeth that mesh with the external teeth are formed, and a casing in which are formed an intake port through which a fluid is taken in and a discharge port through which a fluid is discharged. As a result of the inner rotor being rotated, the external teeth mesh with the internal teeth so as to cause the outer rotor to rotate, and the fluid is taken in or discharged by the volume change in a plurality of cells that are formed between the two rotors.

The cells are individually partitioned on the front side and the rear side in the rotational direction thereof by the external teeth of the inner rotor and the internal teeth of the outer rotor coming into contact with each other, and the two side surfaces are partitioned by the casing. As a result, independent fluid-transporting chambers are formed. In each cell, during the meshing process between the external teeth and internal teeth, after the volume has reached its minimum, the fluid is taken in with its volume expanding as it moves along the intake port, while after the volume has reached its maximum, the fluid is discharged with its volume decreasing as it moves along the discharge port.

SUMMARY OF THE INVENTION

In the above described convention type of internal gear pump, as is illustrated in JP '959, the distance between the rear end in the rotational direction of the two rotors of the intake port and the front end in the rotational direction of the discharge port, namely, the partition width of the ports is larger than the width of the meshing portion of the external teeth in the rotational direction. In other words, the interval between the intake port and the discharge port in a casing at the position where the volume of a cell is at the minimum is larger than the width of the cell whose volume is at the minimum. Because of this, what is known as fluid confinement is generated in which, out of the plurality of cells, the cell having the minimum volume that is located at the meshing position where the two rotors mesh and rotation drive force is transmitted from the external teeth to the internal teeth is sealed. This causes the transporting efficiency (i.e., the ratio of the discharge quantity to the intake quantity) of the internal gear pump to deteriorate and the like.

The present invention was conceived in view of the above described problem points and it is an object thereof to provide an internal gear pump that prevents fluid confinement being generated and has an improved transporting efficiency.

In order to solve the above described problems and achieve the above described object, an internal gear pump of the present invention is an internal gear pump that transports a fluid by taking in and discharging the fluid when an inner rotor and an outer rotor mesh together and rotate using a change in volume of cells that are formed between tooth surfaces of the two rotors, comprising: an inner rotor on which are formed "n" ("n" is a natural number) external teeth; an outer rotor on which are formed "n+1" internal teeth that mesh with the external teeth; and a casing in which are formed an intake port through which the fluid is taken in and a discharge port through which the fluid is discharged, wherein a first angle that is formed by a first straight line that connects a rotation axis of the inner rotor to a tooth tip of an external tooth, and a second straight line that connects the rotation axis to a meshing portion of the external tooth is not less than 1.4 times the size and not more than 1.8 times the size of a second angle that is formed by a third straight line that connects the rotation axis to a tooth bottom of the external tooth, and the second straight line.

According to this invention, because the first angle is not less than 1.4 times and not more than 1.8 times the size of the second angle, the width in the rotational direction of the two rotors at the tooth tip portion including the meshing portion of the external teeth can be widened, and this width can be made close to the distance between the front end of the intake port in the rotational direction and the rear end of the discharge port in the rotational direction, namely, close to the partition width of the ports. Accordingly, it is possible to prevent the generation of what is known as fluid confinement in which, out of the plurality of cells, the cell having the minimum volume that is located at the meshing position where two rotors mesh and rotation drive force is transmitted from the external teeth to the internal teeth is sealed, and it is possible to improve the transporting efficiency of the internal gear pump.

If the first angle is less than 1.4 times the size of the second angle, the above described affects are not apparent and it is not possible to improve the transporting efficiency of the internal gear pump. If the first angle is more than 1.8 times the size of the second angle, the teeth surfaces of the internal teeth of the outer rotor tend to become worn and the durability of the internal gear pump is deteriorated.

The distance between a rear end of the intake port in a rotational direction of the two rotors and a front end of the discharge port in the rotational direction may be made equal to a width in the rotational direction of the meshing portion of the external teeth.

In this case, because the width in the rotational direction of the meshing portion of the external teeth is equal to the partition width of the ports, in the cell having the minimum volume, it is not only possible to avoid the generation of fluid confinement as is described above, but it is also possible to avoid the reverse flow of fluid from the discharge port via the cell having the minimum volume to the intake port, and it is possible to further improve the transporting efficiency of the internal gear pump.

In particular, by setting the first angle so that it is not less than 1.4 times and not more than 1.8 times the size of the second angle, the width in the rotational direction of the two rotors of the tooth tip portion including the meshing portion of the external teeth is made equal to the partition width of the ports. Accordingly, even if the current levels are maintained without the partition width of the ports being made narrower, it is possible to reliably prevent the aforementioned reverse flow from occurring.

According to the internal gear pump of the present invention, it is possible to achieve an improvement in the transporting efficiency.

DETAILED DESCRIPTION OF THE INVENTION

Figure 1:
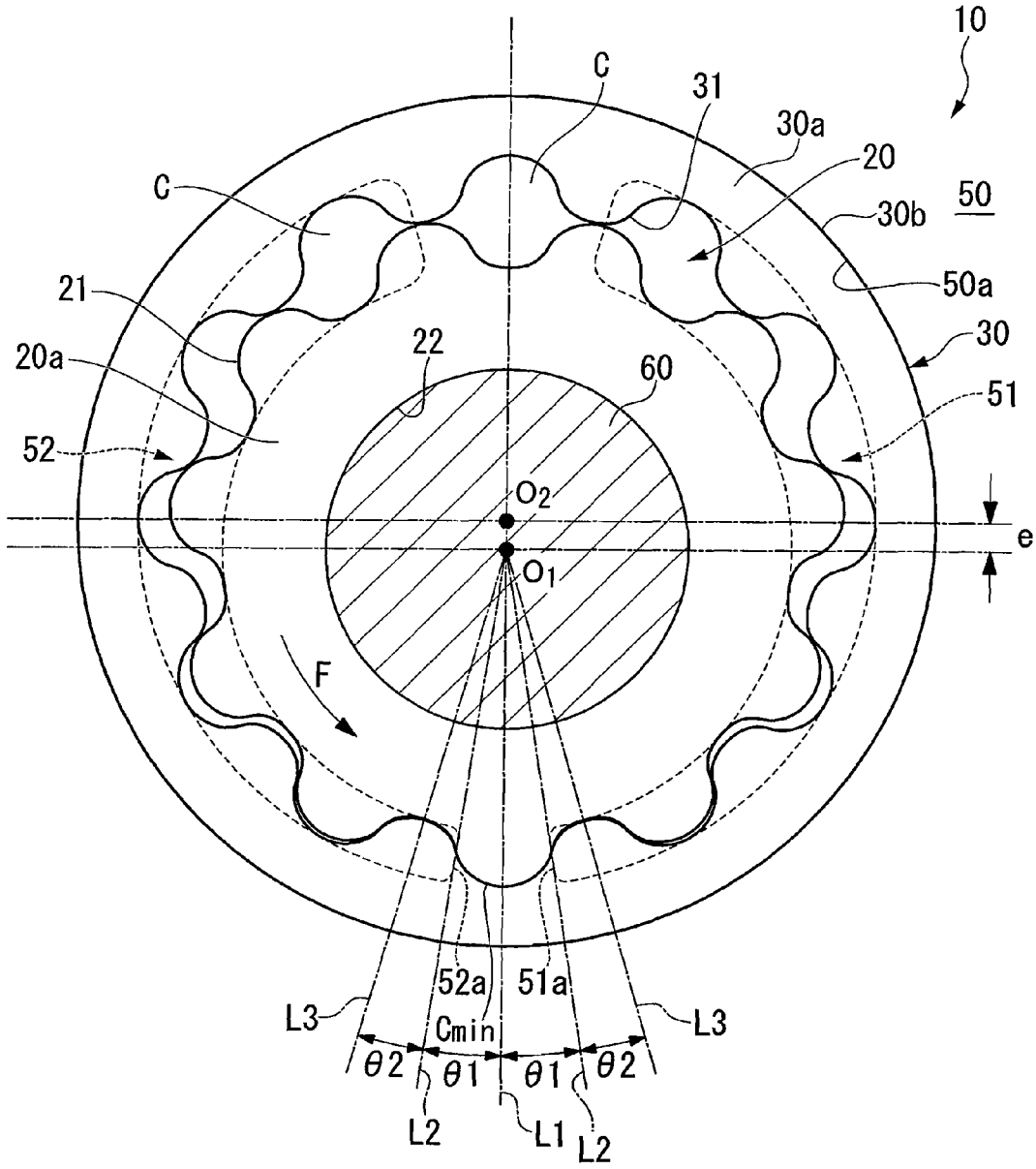
FIG. 1 is a plan view showing principal portions of an internal gear pump according to a first embodiment of the present invention.

An internal gear pump 10 shown in FIG. 1 is formed by an inner rotor 20 on which "n" ("n" is a natural number: n=11 in the present embodiment) external teeth 21 are formed, an outer rotor 30 on which "n+1" internal teeth 31 (n=12 in the present embodiment) that mesh with the respective external teeth 21 are formed, and a drive shaft 60 that is inserted into a mounting hole 22 formed in the inner rotor 20. These are all housed inside a casing 50. A rotation axis $O_2$ of the outer rotor 30 is offset by an offset amount "e" from a rotation axis $O_1$ of the inner rotor 20. A rotation axis of the drive shaft 60 matches the rotation axis $O_1$ of the inner rotor 20.

As a result of the drive shaft 60 rotating around the rotation axis $O_1$, a rotation drive force thereof is transmitted to the mounting hole 22 and the inner rotor 20 also rotates around the rotation axis $O_1$. The rotation drive force of the inner rotor 20 is transmitted to the outer rotor 30 as a result of the external teeth 21 meshing with the internal teeth 31, and the outer rotor 30 rotates around the rotation axis $O_2$.

Figure 5:
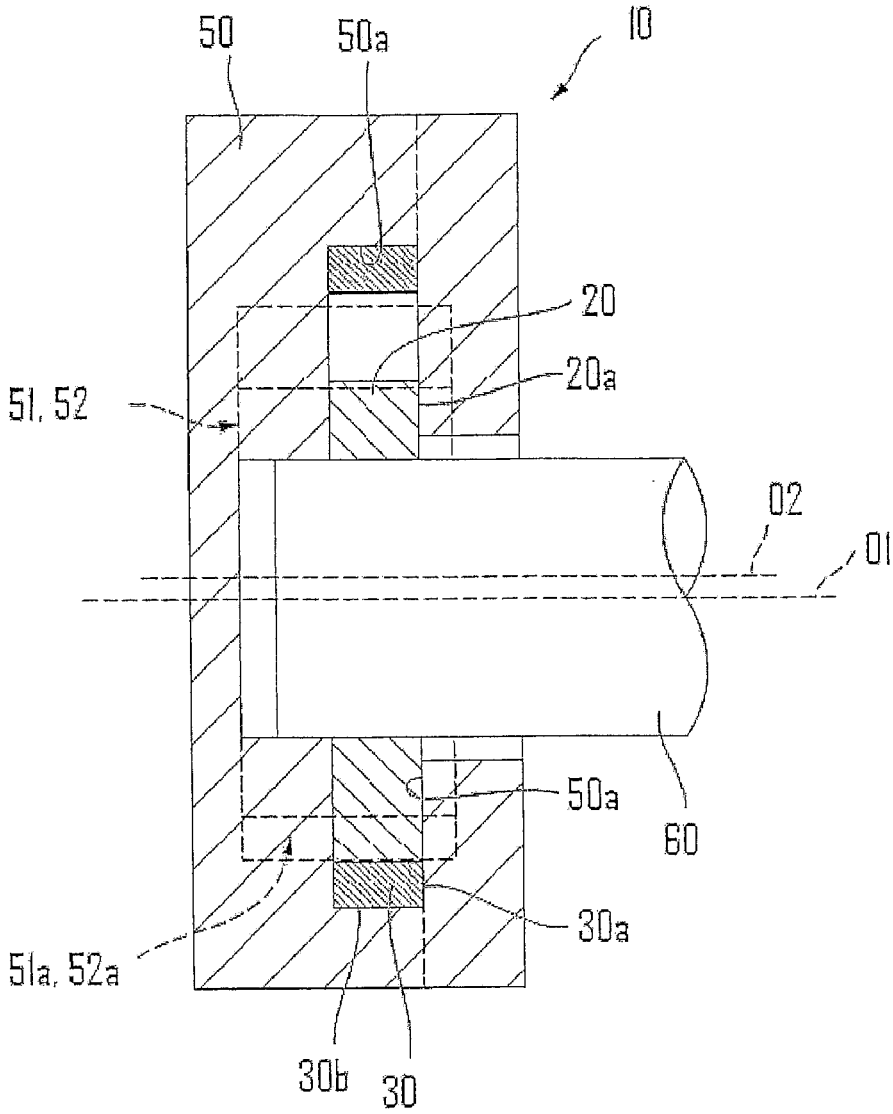
FIG. 5 is a cross sectional view showing principal portions of an internal gear pump according to a first embodiment of the present invention.

When the inner rotor 20 and the outer rotor 30 are rotating, an internal surface 50*a* of the casing 50 is in sliding contact with an end surface 20*a* of the inner rotor 20, an end surface 30*a* of the outer rotor 30, and an external circumferential surface 30*b* of the outer rotor 30, as seen in FIG. 5.

A plurality of cells C are formed between gear teeth surfaces of the inner rotor 20 and gear teeth surfaces of the outer rotor 30 running in a rotational direction F of the inner rotor 20 and the outer rotor 30. Each cell C is individually partitioned on the front side and the rear side in the rotational direction F as a result of the external teeth 21 of the inner rotor 20 and the internal teeth 31 of the outer rotor 30 being in contact with each other. In addition, both side surfaces of each cell C are partitioned by the internal surface 50*a* of the casing 50. As a result, independent fluid transporting chambers are formed. The cells C are moved in a rotation that accompanies the rotation of the inner rotor 20 and the outer rotor 30 and their volume expands and contracts repeatedly with one rotation taken as one cycle. The rotation drive force of the inner rotor 20 is transmitted to the outer rotor 30 as a result of an external tooth 21 meshing with an internal tooth 31 at the position where the cell $C_{min}$ having the minimum volume is formed.

An intake port 51 that has a circular arc shape when seen in plan view and communicates with the cells C as their volume expands, and a discharge port 52 that has a circular arc shape and communicates with the cells C as they contract are provided in the casing 50. Fluid that is taken into the cells C from the intake port 51 is transported in conjunction with the rotation of the inner rotor 20 and the outer rotor 30 and is discharged from the discharge port 52.

The inner rotor 20 shown in the drawings is formed so as to have for the shape of a tooth tip portion 21*b* of the external teeth 21 an epicycloid curve that is created by a first epicycle that circumscribes a first base circle "di" while rotating without slipping, and having for the shape of a tooth groove portion 21*c* of the external teeth 21 a hypocycloid curve that is created by a first hypocycle that inscribes the first base circle "di" while rotating without slipping.

The outer rotor 30 is formed so as to have for the shape of a tooth groove portion 31*b* of the internal teeth 31 an epicycloid curve that is created by a second epicycle that circumscribes a second base circle "do" while rotating without slipping, and having for the shape of a tooth tip portion 31*c* of the internal teeth 31 a hypocycloid curve that is created by a second hypocycle that inscribes the second base circle "do" while rotating without slipping.

Figure 2:
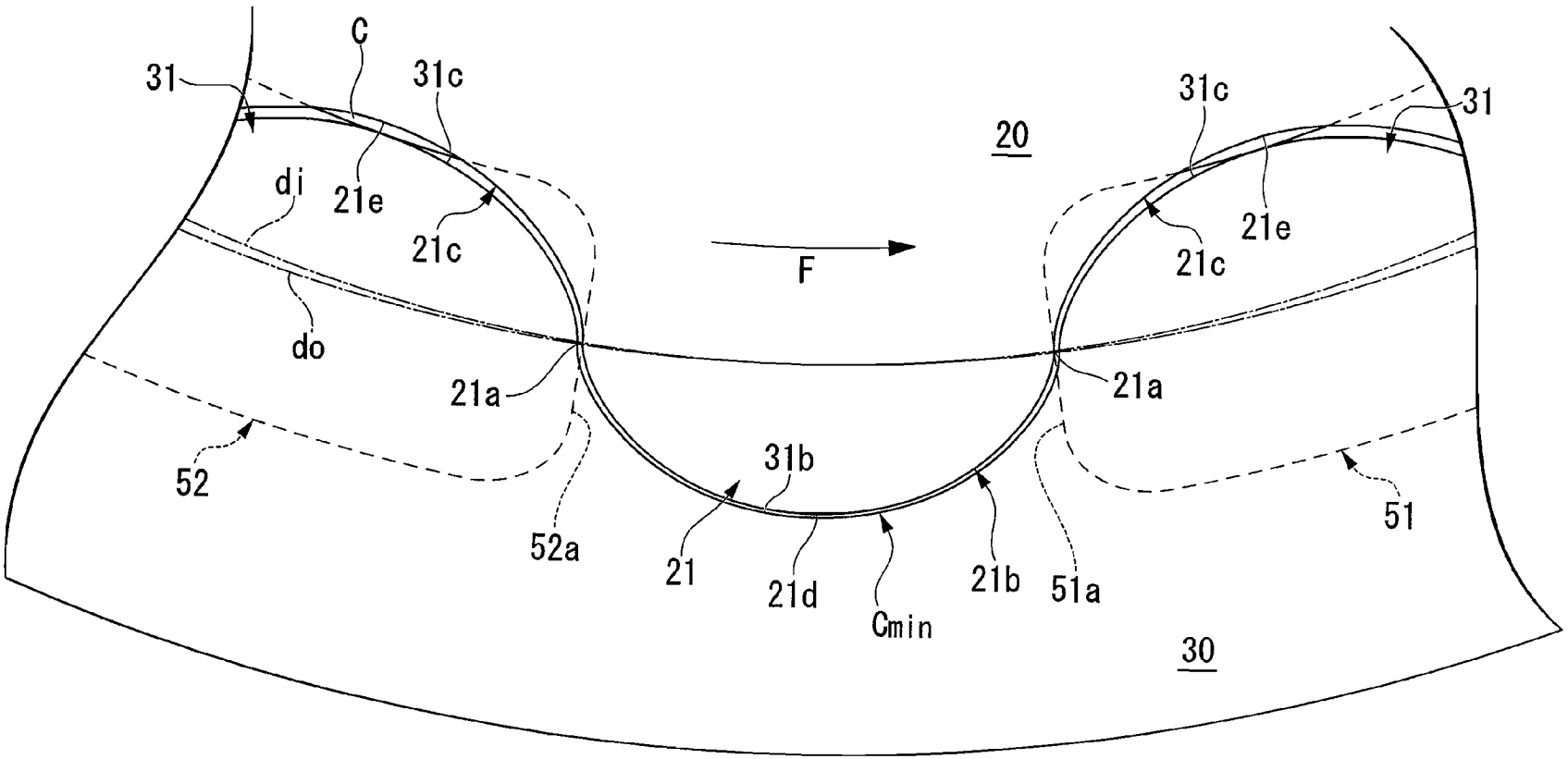
FIG. 2 is an enlarged view showing a meshing portion of the internal gear pump shown in FIG. 1.

In the present embodiment, a first angle θ1 that is formed by a first straight line L1 that connects the rotation axis $O_1$ of the inner rotor 20 to a center portion in a transverse direction of an external tooth 21 in the rotational direction F, namely, to the center of a tooth tip 21*d*, and a second straight line L2 that connects the rotation axis $O_1$ to a meshing portion 21*a* of the external tooth 21 is not less than 1.4 times the size and not more than 1.8 times the size of a second angle θ2 that is formed by a third straight line L3 that connects the rotation axis $O_1$ to a tooth bottom 21*e* of an external tooth 21, and the second straight line L2. As is shown in FIG. 2, the meshing portion 21*a* of the external teeth 21 is an intersection between a gear tooth surface of an external tooth 21 and the first base circle "di".

A distance in the circumferential direction between a rear end 51*a* in the rotational direction F of the intake port 51 and a front end 52*a* in the rotational direction F of the discharge port 52 is equal to the width at the meshing portions 21*a* of the external teeth 21 in the rotational direction F. In the present embodiment, the distance between the intersection between the rear end 51*a* of the intake port 51 and the first base circle "di" and the intersection between the front end 52*a* of the discharge port 52 and the first base circle "di" is equal to the width at the meshing portions 21*a* of the external teeth 21 in the rotational direction F.

As has been described above, according to the internal gear pump 10 of the present embodiment, because the first angle θ1 is not less than 1.4 times the size and not more than 1.8 times the size of the second angle θ2, the width in the rotational direction F of the inner rotor 20 and the outer rotor 30 at the tooth tip portion 21*b* including the meshing portions 21*a* of the external teeth 21 can be made close to the distance between the rear end 51*a* of the intake port 51 and the front end 52*a* of the discharge port 52, namely, close to the partition width of the ports. Accordingly, it is possible to prevent the generation of what is known as fluid confinement in which, out of the plurality of cells C, the cell $C_{min}$ having the minimum volume that is located at the meshing position where the inner rotor 20 and the outer rotor 30 mesh and rotation drive force is transmitted from the external teeth 21 to the internal teeth 31 is sealed, and it is possible to improve the transporting efficiency of the internal gear pump 10.

Because the width in the rotational direction F of the meshing portions 21*a* of the external teeth 21 is equal to the partition width of the ports, in the cell $C_{min}$ having the minimum volume, it is not only possible to avoid the generation of fluid confinement as is described above, but it is also possible to avoid the reverse flow of fluid from the discharge port 52 via this cell $C_{min}$ to the intake port 51. Accordingly, it is possible to further improve the transporting efficiency of the internal gear pump 10.

In particular, by setting the first angle θ1 so that it is not less than 1.4 times and not more than 1.8 times the size of the second angle θ2 and widening the width in the rotational direction F of the tooth tip portion 21*b* including the meshing portions 21*a* of the external teeth 21, this width is made equal to the partition width of the ports. Accordingly, the current levels can be maintained without the partition width of the ports becoming narrower, and it is possible to reliably prevent the aforementioned reverse flow from occurring.

The technical range of the present invention is not limited to the above described embodiment and various modifications may be made thereto without departing from the purpose of the present invention.

For example, in the above described embodiment a structure is employed in which the configurations of the external teeth 21 and the internal teeth 31 are formed based on a cycloid curve; however, instead of this, it is also possible for the gear tooth surface configuration to be formed based on, for example, a trochoid curve.

By setting the first angle θ1 so that it is not less than 1.4 times the size and not more than 1.8 times the size of the second angle θ2, if the width in the rotational direction F of the tooth tip portion 21*b* including the meshing portion 21*a* of the external teeth 21 is widened, then the width in the rotational direction F at the meshing portions 21*a* of the external teeth 21 does not need to be equal to the partition width of the ports.

Verification Experiments

Verification experiments were performed for the operating effects of the present invention. A plurality of structures having a variety of different ratios between the first angle θ1 and the second angle θ2 were employed for the internal gear pumps provided in this experiment. In the respective internal gear pumps, the actual discharge quantities were measured when the discharge pressure was set to 300 kPa and the inner rotor was rotated at 750 rpm. These discharge quantities were then divided by a theoretical discharge quantity and the volume efficiency was calculated by multiplying the obtained values by 100.

Figure 3:
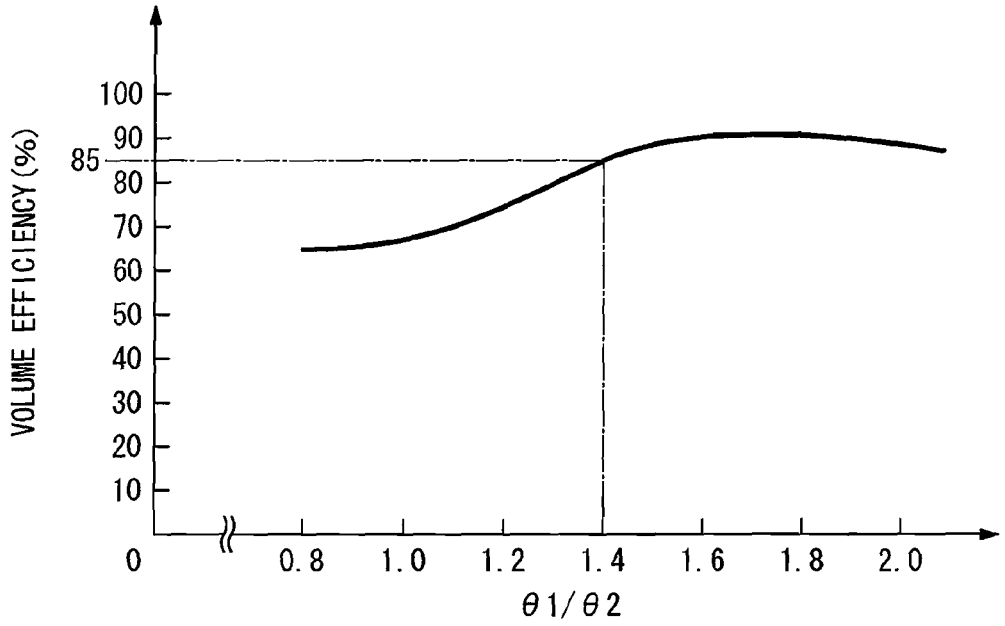
FIG. 3 is a graph showing results of a first experiment to examine operating effects of the internal gear pump according to the present invention.

As is shown in FIG. 3, the results showed that if the first angle θ1 is equal to or more than 1.4 times the size of the second angle θ2, then the volume efficiency was 85% or more and it was confirmed that the transporting efficiency was improved.

Next, in each of the plurality of internal gear pumps, the maximum wear amounts of the gear tooth surfaces of the internal teeth of the outer rotor were measured when the discharge pressure was set to 600 kPa and the inner rotor was rotated at 6000 rpm for 500 hours.

Figure 4:
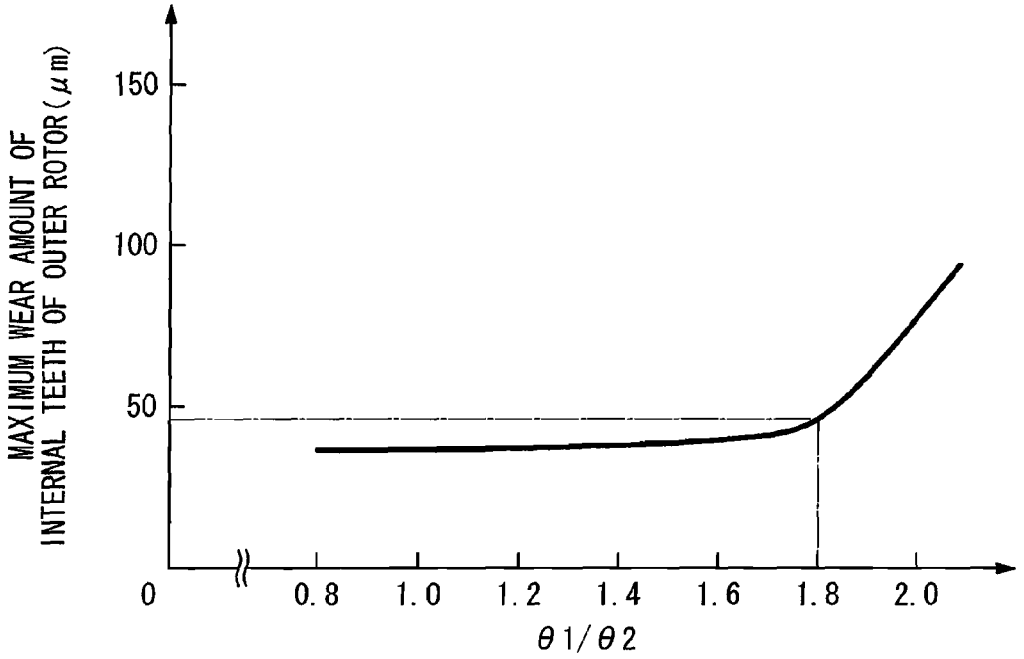
FIG. 4 is a graph showing results of a second experiment to examine operating effects of the internal gear pump according to the present invention.

As is shown in FIG. 4, the results showed that if the first angle θ1 is equal to or less than 1.8 times the size of the second angle θ2, then the maximum wear amount was restricted to 50 μm or less and it was confirmed that the durability of this internal gear pump was kept equal to current levels.

As a result of the above, by setting the first angle θ1 to be not less than 1.4 times and not more than 1.8 times the size of the second angle θ2, it was confirmed that wear of the gear tooth surfaces of the internal teeth of the outer rotor was suppressed while the transporting efficiency of the internal gear pump was improved.

An internal gear pump can be provided in which the occurrence of fluid confinement is prevented and the transporting efficiency is improved.

The invention claimed is:

1. An internal gear pump that transports a fluid by taking in and discharging the fluid when an inner rotor and an outer rotor mesh together and rotate using a change in volume of cells that are formed between tooth surfaces of the two rotors, comprising:

the inner rotor on which are formed "n" ("n" is a natural number) external teeth;

the outer rotor on which are formed "n+1" internal teeth that mesh with the external teeth; and a casing in which are formed an intake port through which the fluid is taken in and a discharge port through which the fluid is discharged, wherein a first angle that is formed by a first straight line that connects a rotation axis of the inner rotor to a tooth tip of an external tooth, and a second straight line that connects the rotation axis to a meshing portion of the external tooth is not less than 1.4 times a size and not more than 1.8 times the size of a second angle that is formed by a third straight line that connects the rotation axis to a tooth bottom of the external tooth, and the second straight line.

2. The internal gear pump according to claim 1, wherein a distance between a rear end of the intake port in a rotational direction of the two rotors and a front end of the discharge port in the rotational direction is made equal to a width in the rotational direction of the meshing portion of the external teeth.

* * * * *